United States Patent [19]

Williams et al.

[11] Patent Number: 4,904,220

[45] Date of Patent: Feb. 27, 1990

[54] PUPPET MOBILE

[75] Inventors: David M. Williams, New York; Lois E. Kelly, Brooklyn, both of N.Y.

[73] Assignee: The Child Growth & Development Corporation, New York, N.Y.

[21] Appl. No.: 175,703

[22] Filed: Mar. 31, 1988

[51] Int. Cl.[4] ..... A63H 33/00

[52] U.S. Cl. ..... 446/227; 446/236

[58] Field of Search ..... 446/227, 228, 229, 236, 446/251, 265; 40/617

[56] References Cited

U.S. PATENT DOCUMENTS

| | | | |
|---|---|---|---|
| 810,900 | 1/1906 | Bartlett | 446/227 X |
| 3,699,704 | 10/1972 | Hakim | 446/227 |
| 3,803,735 | 4/1974 | Stubbmann | 40/617 X |
| 4,640,034 | 2/1987 | Zisholtz | 446/227 X |
| 4,722,713 | 2/1988 | Williams et al. | 446/227 |
| 4,756,109 | 7/1988 | Marcus | 40/617 X |

*Primary Examiner*—Robert A. Hafer
*Assistant Examiner*—Sam Rimell
*Attorney, Agent, or Firm*—Townsend & Townsend

[57] ABSTRACT

An article of manufacture adapted to be suspended as a mobile or placed on a flat surface to serve as a bedside display and including a plurality of paddles, each adapted for receipt of a hand puppet. The device may be suspended as a mobile from a hook or removed from the hook and supported on a flat surface such as a night stand or shelf. The paddles are two-position paddles having a first angled position when supported on the mobile and a second upright position when supported on the flat surface. The apparatus includes a wind-up device which, when activated, causes the mobile to rotate. When the device is wound, a musical melody plays as the device rotates. The hand puppets are removably positioned on each of the paddles.

14 Claims, 1 Drawing Sheet

PUPPET MOBILE

BACKGROUND OF THE INVENTION

1. Field of the Invention

This invention relates to a mobile adapted to be suspended over a baby's crib.

Mobiles may be attached to the side of a crib and often include colorful figures which move in order to capture the baby's attention. These mobiles often remain attached to the crib until the infant outgrows them, when the baby is approximately aged five months.

2. Description of the Prior Art

U.S. Pat. No. 4,654,991 discloses a toy hanger for visually displaying toys, dolls or the like within a child's room in which the items are suspended from a support structure. The items are attached to hanging straps for the purpose of storing the items. In one embodiment, the straps are secured at upper ends to carrier arms formed at spaced angular intervals from each other on a carousel structure. The carousel may be supported on a base, but the toys do not move with respect to the support.

SUMMARY OF THE INVENTION

The present invention is a mobile which may be attached to the side of a crib. The mobile may also be removed from the crib and placed on a night stand, bedside table or shelf.

The mobile includes support paddles for retaining hand puppets on the mobile. The apparatus includes a base suspended from a support arm which is attached to the crib. A hook is attached to the base and suspended from an extension arm, which is, in turn, suspended from the support arm. The support paddles are movable between a first position in which a paddle is angled with respect to the base and a second position wherein the paddle is upright with respect to the base.

The mobile may be removed from the support arm and placed on a table or night stand. In this position, the support paddles are moved to their second upright position for displaying the puppets.

In either position, the puppets slip easily off their support paddles and can be used by both parent and child. The carousel unit, including a wind-up melody mechanism, serves as a support when the device is placed on a shelf for bedside display and also serves as a music box.

Because the device may be used removed from the crib when the child outgrows its use as a mobile and used as a bedside display, the child may enjoy the puppets and music as he or she gets older.

DETAILED DESCRIPTION OF THE PREFERRED EMBODIMENT

Figure 1:
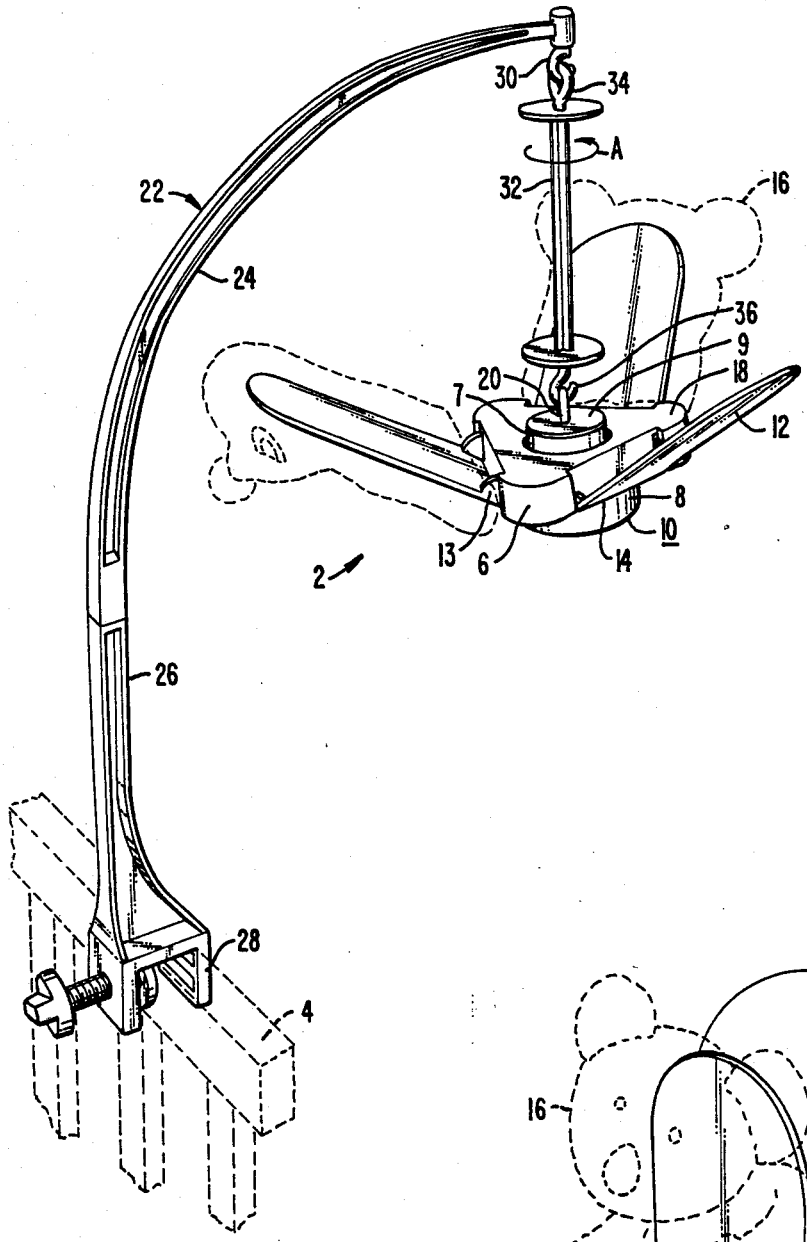
FIG. 1 is a perspective view of the present invention in its first position attached to the side of a crib.

The mobile 2 of the present invention is suspended over a crib 4 and includes hand puppets 16 angled for a baby's view. The mobile includes a triangular base 6 and a carousel 8 having a flat lower surface 10. The carousel 8 is circular in shape and attached to the bottom of base 6. Flat lower surface 10 is the bottom surface of carousel 8 facing away from the interface between base 6 and carousel 8. Three support paddles 12 extend from base 6 outwardly and are movable between first and second positions. The first position is angled with respect to the base approximately 45 degrees. The second position is upright with respect to base 6 at an angle of approximately 90 degrees.

Fabric hand puppets 16 are removably received on each of the support paddles 12. Support paddles 12 are substantially flat and sized to receive hand puppets 16. The support paddles include a lower edge 14 hingeably connected to each side of triangular base 6. Hinges 13 are integrally formed at opposite sides of lower edges 14 of paddles 12. Hinges 13 are mounted perpendicularly to the flat surface of support paddles 12 and extend through slots 11 into base 6. By rotating support paddles 12 about hinges 13, the support paddles slide into slots 11 and may assume either their first angled position, or their second upright position.

Upper protrusion 7 is positioned at the center of upper surface 18 of base 6. Flat disk 9 of carousel 8 extends through base 6 and above upper protrusion 7. Hook 20 is formed on flat disk 9 for suspending mobile 2 above crib 4 from support arm 22.

Support arm 22 includes a clamp 28 removably attached to the side of crib 4. Support arm 22 includes an upper portion 24 and a lower portion 26. Clamp 28 is integrally formed with the lower portion 26 of support arm 22. Upper portion 24 of support arm 22 is received on lower portion 26 and curved to extend over the baby while the baby is in crib 4. Hook 30, formed at the outer curved end of upper portion 24, receives a hook 34 formed on an upper end of extension bar 32. The opposite end of extension bar 32 includes an additional hook 36 for receiving hook 20 of mobile 2.

Carousel 8 includes a wind-up music drive mechanism. A winding key (not shown) is received on flat lower surface 10 of carousel 8. When the drive mechanism is activated, base 6 and carousel 8 rotate with respect to each other, such that base 6, along with puppets 16, rotate for the baby's viewing. As the drive mechanism unwinds, it acts as a music box, playing a song. The song may be any melody which would appeal to an infant or young child. An example would be "Twinkle, Twinkle, Little Star."

In operation, hook 34 of extension bar 32 is attached to hook 30 of support arm 22. Hook 20 of mobile 2 is attached to the opposite end of extension bar 32 at hook 36. Support paddles 12 are placed in their first angled position (as seen in FIG. 1) so that a baby lying in crib 4 can easily view puppets 16.

Musical carousel 8 is wound by a key (not shown) on flat lower surface 10. The key winds a drive mechanism (not shown) causing carousel 8 to rotate with respect to base 6 and simultaneously play music. Because hook 20 of mobile 2 is attached to flat disk 9 of carousel 8, base 6 along with support paddles 12 and hand puppets 16 rotate in the direction of arrow A overhead for the baby's amusement.

Figure 2:
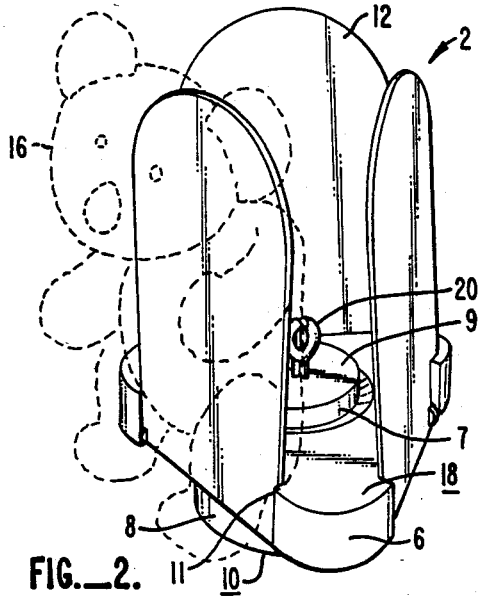
FIG. 2 is a perspective view of the present invention in its second position supported on a table or night stand.

Alternatively, mobile 2 may be removed from hook 36 and used as a bedside display and music box. Flat lower surface 10 is supported on a night stand or shelf. Support paddles 12 are rotated about hinges 13 to their second upright position (as seen in FIG. 2). When the key is wound, base 6 rotates with respect to carousel 8 along with puppets 16, playing music as the device rotates.

Support paddles 12 are approximately the size of an adult's hand so that hand puppets 16 may easily slide onto the supports when mobile 2 is either attached to the crib or supported on a table or night stand. When one desires to play with hand puppets 16, the puppets are slid off support paddles 12 and onto the hand of an adult or child.

This invention has been described with reference to the preferred embodiment. Variations and modifications can be made without departing from the scope of the present invention, which is limited only by the following claims.

We claim:

1. A device comprising:

a base with a flat lower surface for supporting said base on a horizontal surface;

a receiving hook attached to said base for suspending said device as a mobile;

hand puppet retaining means pivotally attached to said base, said means being movable between first and second positions wherein said first position is angled with respect to a horizontal plane and said second position is upright with respect to said horizontal plane.

2. The device as defined by claim 1 wherein said hand puppets retaining means comprises a plurality of support paddles.

3. The device as defined by claim 2 wherein said support paddles are flat.

4. The device as defined by claim 2 wherein said hand puppets substantially cover said support paddles when supported thereon.

5. The device as defined by claim 1 including means for rotating said base.

6. The device as defined by claim 5 wherein said rotating means includes a drive mechanism for rotating said base.

7. The device as defined by claim 6 further including means for playing a musical melody.

8. The device as defined by claim 7 wherein said drive mechanism activates said means for playing said melody.

9. The device as defined by claim 1 further including a support arm for suspending said device above a crib.

10. The device as defined by claim 1 wherein said first and second positions comprise stable hinged positions for said paddles.

11. The device as defined by claim 1 wherein said hand puppet includes an opening adapted for receipt of a hand.

12. A device adapted to be both suspended as a mobile and supported on a flat surface comprising:

a base having a flat lower surface and an upper protrusion;

suspending means extending from said base and having a flat disk mounted above said upper protrusion;

a hook integrally formed on said flat disk for suspending said base as a mobile;

a plurality of two-position support paddles each adapted for receipt of a hand puppet, said support paddles pivotally attached to said base and being movable between first and second positions wherein said first position is angled with respect to said base and said second position is upright with respect to said base.

13. The device as defined by claim 12 wherein said support paddles include a paddle edge comprising a hinge integrally attached to said paddle edge at an interface of said support paddle and said base and wherein said support paddles are movable between said first and said second positions on said base by said hinge.

14. The device as defined by claim 13 wherein said base includes a slot positioned at the edges of said support paddles, said hinges being slidably received in said slots.

* * * * *